United States Patent [19]

Spector

[11] Patent Number: 4,867,018

[45] Date of Patent: Sep. 19, 1989

[54] PHILLIPS SCREWDRIVER WITH RETRACTABLE SLOTTED SCREWDRIVER BLADE

[76] Inventor: Samuel Spector, 14 Brookfall Rd., Edison, N.J. 08817

[21] Appl. No.: 240,061

[22] Filed: Aug. 26, 1988

[51] Int. Cl.[4] ..... B25B 23/00

[52] U.S. Cl. ..... 81/439; 81/444; 81/461

[58] Field of Search ..... 81/437–439, 81/442–447, 460–461

[56] References Cited

U.S. PATENT DOCUMENTS

| | | | |
|---|---|---|---|
| 411,190 | 9/1889 | Haines | 81/437 |
| 1,057,101 | 3/1913 | Wachter | 81/438 |
| 2,559,206 | 7/1951 | Wienholtz | 81/444 |
| 4,328,721 | 5/1982 | Massari | 81/439 |
| 4,488,462 | 12/1984 | Wall | 81/439 |

*Primary Examiner*—D. S. Meislin

*Attorney, Agent, or Firm*—Henry Schanzer; Michael Y. Epstein

[57] ABSTRACT

A screwdriver for alternative use with Phillip head screws and slotted head screws is disclosed comprising a handle and a shank extending therefrom, the leading end of the shank terminating in a Phillips head screw engaging bit. The leading end portion of the shank is bifurcated by a rearwardly extending slot, and an elongated blade tipped with a slotted head screw bit is slidingly disposed along the slot. The blade is provided with a series of gear teeth along each edge and a nut is mounted around the shank for engagement with the blade teeth. The nut maintains the blade within the slot, and rotation of the nut controls the axial positioning of the blade to positions either forwardly or rearwardly of the Phillips bit.

6 Claims, 2 Drawing Sheets

PHILLIPS SCREWDRIVER WITH RETRACTABLE SLOTTED SCREWDRIVER BLADE

BACKGROUND OF THE INVENTION

This invention relates to screwdrivers of the type incorporating, within a single tool, screw bits which can be alternatively used with either slotted or Phillips headed screws.

Screwdrivers of this type are generally known. U.S. Pat. No. 4,328,721, which is the closest prior art known to me, shows a screwdriver including a tubular shank terminating at its leading end with a Phillips head screw bit. Disposed within the tubular shank, and moveable therewithin, is an elongated, rectangular blade terminating at its leading end with a slotted screw bit. The Phillips head screw bit, while otherwise conventional, includes an axially extending rectangular slot which extends entirely through the bit and opens into the interior of the shank. The elongated blade within the shank is aligned with the slot through the Phillips bit, and means are provided for advancing the leading end of the blade through and beyond the Phillips bit, thereby exposing, for use, the slotted screw bit at the end of the blade. Means are also provided for withdrawing the blade rearwardly of the Phillips bit, allowing use of the screwdriver as a Phillips screwdriver.

The blade advancing means includes a latch means which is disposed within the handle of the screwdriver. This allows for but a single exposed length of the exposed blade, i.e., the length of the exposed blade is not variable by the user, and the handle of the screwdriver is more complex and expensive than that in a conventional, single purpose screwdriver.

The present invention is directed to a screwdriver of the type aforedescribed, but including improvements in the means for advancing and retracting the interior blade, and including structural changes for increasing the strength of the screwdriver while reducing its complexity and cost.

SUMMARY OF THE INVENTION

The inventive screwdriver, generally of the aforedescribed type, comprises a conventional handle and an elongated shank extending axially therefrom. The shank terminates, at its leading end, with a Phillips head screw bit, and the shank, for over half its rearwardly extending length (i.e., the shank portion connected to the handle) is preferably solid, thereby increasing the strength of the shank.

The leading end portion of the shank, however, is provided with an axially extending slot which bifurcates the shank into two spaced apart, parallel sections having facing flat surfaces. Slideably disposed within the slot is an elongated blade having, at its leading end, a slotted screw engaging bit.

Encircling the shank, in fixed axial position there along intermediate the end of the slot, is an elongated nut. The elongated blade is provided with gear teeth along the length of the blade which engage the nut internal screw thread. The nut serves both to maintain the blade within the slot and to control the axial position of the blade along the slot.

DETAILED DESCRIPTION

Figure 1:
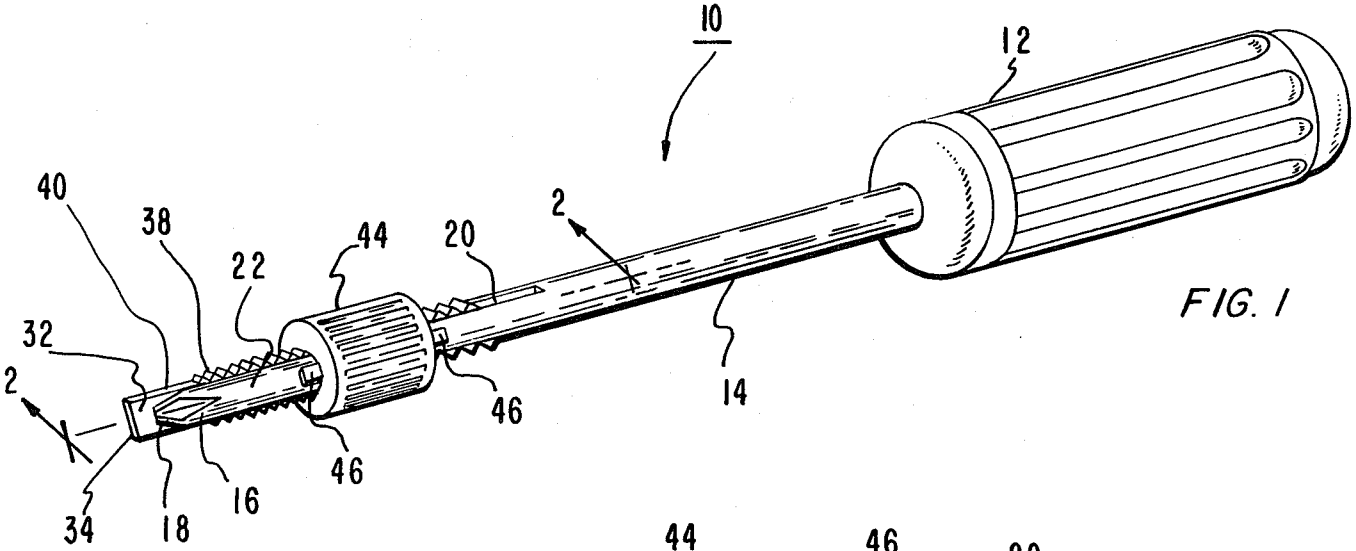
FIG. 1 is a view, in perspective, of the inventive screwdriver with the elongated blade in its outwardly projected position.

With reference to FIG. 1 which shows a perspective view of the inventive screwdriver, the screwdriver 10 comprises a handle 12 which can be of conventional solid type in which is embedded the rearward end of a shank 14, generally of a strong metal, e.g., stainless steel. Preferably, the shank is of circular and solid cross-section.

The leading end of the shank terminates in a Phillips head screw engaging bit 16, i.e., a bit including four peripherally spaced, forwardly tapering lugs 18 designed to mate with the walls of the cross-shaped recess of conventional Phillip head screws.

Figure 3:
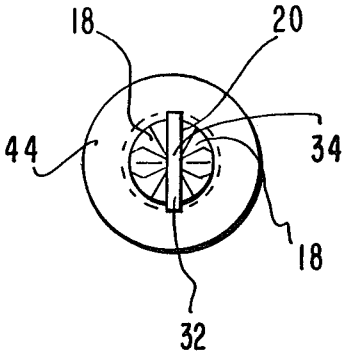
FIG. 3 is an enlarged end view of the screwdriver of FIG. 1 looking from the left of FIG. 1.

The shank 14, which as previously noted, is preferably of solid cross-section, for greater strength, is provided with an axially extending slot 20 (see, also, FIG. 4), starting from the tip of the bit 16 and extending some distance (not critical, e.g., about ⅓ of the length of the exposed portion of the shank 14) rearwardly therefrom. The slot 20 bifurcates the leading portion of the shank into two spaced apart sections 22 and 24 having flat surfaces 26 and 28. The Phillips head bit 16 is also bifurcated, but the width of the slot 20 is so small (depending upon the overall size of the screwdriver), that, while the tips of the four lugs need not actually meet, as in a conventional Phillips head bit, the bit lugs come sufficiently close together to permit easy entry of the bit into, and normal usage of the screwdriver 10 with Phillips head screws. As shown in FIG. 3, the slot 20 bisects the included angles formed between oppositely disposed pairs of lugs 18.

Disposed within the slot 20 is a thin, flat elongated blade 32 having a generally rectangular cross-section. The leading end of the blade 32 comprises a slotted head screw engaging bit 34. Although not shown in FIG. 1, the major surfaces of the bit 34 can taper forwardly inwardly as is common with slotted screwdriver bits.

The thickness of the blade 32 is approximately equal to but slightly less than the width of the slot 20, the blade 32 thus being freely moveable axially along the slot but in relatively snug fit therewith. When the screwdriver 10 is used, as described hereinafter, the slot walls 26 and 28 provide torsional strength for the blade 32 in its outwardly extended position.

The width of the blade 32 is generally equal to the height of the slot 20, i.e., generally equal to the diameter of the shank 14. In addition, however, a series of generally triangular gear teeth 38 is provided along each minor side surface 40 of the blade 32. The teeth 38 extend beyond the slot walls, and beyond (FIG. 2) the outer surfaces of the shank sections 22 and 24.

The length of the blade 32 is not critical but must be slightly less than the axial length of the slot 20. This allows full withdrawal of the blade 32 rearwardly of the Phillips bit 16.

An elongated nut 44 is provided encircling the shank 14 at an axial position intermediate the ends of the slot 20. The internal thread of the nut 44 meshes with the teeth 38 of the blade 32 (the pitch of the screw thread being equal to the spacing between the teeth). Stop means, such as pins 46 which extend from each shank section 22 and 24 adjacent to each end of the nut 44, prevent axial movement of the nut along the shank. Thus, upon rotation of the nut (which is freely rotatable about the shank), the blade is caused to advance in either direction along the slot.

The nut 44 encircles both the shank 14 and the blade 32 and provides the sole means for retianing the blade within the slot. To this end, as shown in FIG. 1, the length of the nut is preferably equal to at least half the length of the blade. Thus, even with the blade fully extended, as shown in FIG. 1, at least half the length of the blade is supportingly engaged with the nut.

Figure 2:
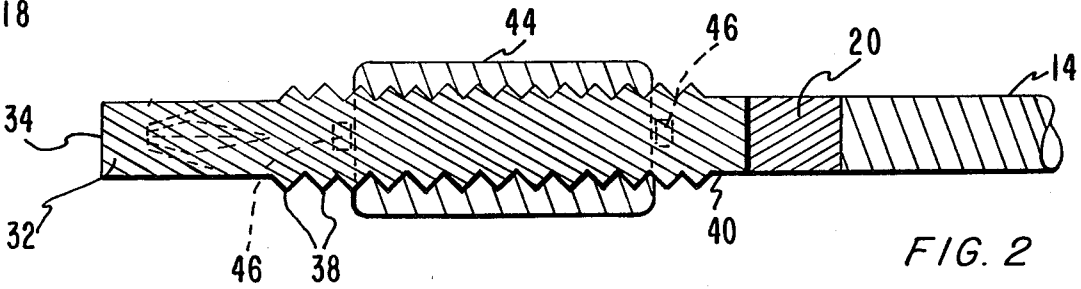
FIG. 2 is a cross-sectional view, on an enlarged scale, of the screwdriver shown in FIG. 1 along the plane indicated by the section line 2—2 of FIG. 1.

In use of the screwdriver 10, the axial position of the blade 32 along the slot 20 is adjusted by means of the nut 44. When the blade 32 is in its advanced, exposed position, as illustrated in FIGS. 1 and 2, the screwdriver 10 is useable as a conventional slotted head screwdriver. During such use, the torque exerted against the blade 32 is resisted by the walls of the shank sections 22 and 24. Turning a screw does not cause turning of the nut 44, hence the axial position of the blade is not changed during use of the screwdriver.

One advantage of the nut-blade teeth advancing mechanism of the present invention is that the extended length of the blade 32 is fully adjustable (up to its maximum extended length) by the user of the screwdriver. This is desirable with use with different size screws. Such control over the extended length of the slotted head blade is not possible with the aforedescribed prior art screwdriver.

When the blade 32 is retracted within the slot 20 and positioned rearwardly of the Phillips bit 16 (see FIG. 4), the screwdriver is useable as a conventional Phillips screwdriver.

Figure 4:
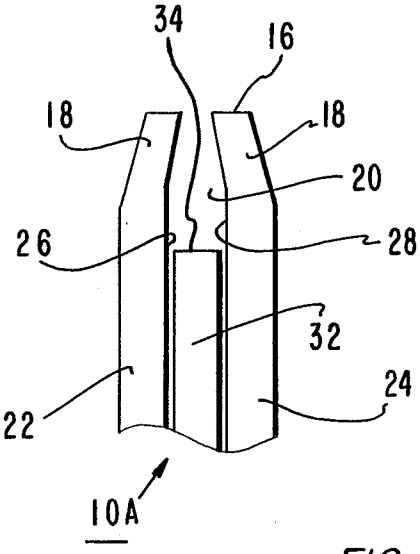
FIG. 4 is an enlarged plan view of the leading end of the shank of a modified form of the screwdriver shown in FIG. 1.

FIG. 4 shows a modified form 10A of the inventive screwdriver, the figure showing the blade 32 in its rearward position. The modification is that, immediately adjacent to the tip of the Phillips bit 16, the width of the slot 20 tapers forwardly inwardly to a dimension slightly less than the thickness of the blade 32.

In use of the modified screwdriver 10A as a slotted screwdriver, the spaced apart shank sections 22 and 24 are easily resiliently pushed aside when the blade is advanced to its exposed position. However, both slot walls firmly engage the major surfaces of the blade 32 and provide greater torsional ability.

In use of the screwdriver 10A as a Phillips screwdriver, with the blade 32 retracted (as shown in FIG. 4), it is possible to slightly adjust the dimensions of the Phillips bit 16 by advancing the blade 32 into the constricted portion of the slot 20. Thi slightly spreads apart the bit lugs 18, thereby increasing the diameter of the Phillilps bit. This can be done before the Phillilps bit is inserted into a screw head, for better matching the size of the bit to the screw, or after insertion of the bit into the screw, for increasing the pressure of the bit lugs against the screw recess walls. The ability to control the positioning of the blade 32 thus enabled better and firmer gripping of the screw for more effective turning of the screw.

What is claimed is:

1. A screwdriver for alternative use with Phillips head screws and slotted head screws, said screwdriver including a handle and a shank extending therefrom, the leading end of said shank terminating in a Phillips head screw engaging bit, said leading end being bifurcated into spaced apart sections by a rearwardly extending slot, an enlongated blade tipped with a slotted head screw engaging bit slidingly disposed within a slotted head and axially aligned therewith, said blade having a series of gear teeth spaced along at least one side surface thereof, said teeth extending in a direction laterally parallel to and to a distance beyond the walls of said slot, and an elongated nut encircling a length of said shank sections, said nut being freely rotatable about said sections but being in fixed axial position therealong, the screw thread of said nut being engaged with said blade teeth for advancing said blade along and partially beyond the open end of said slot upon rotation of said nut.

2. A screwdriver according to claim 1 in which said shank is of slid cross-section rearwardly of said slot.

3. A screwdriver according to claim 1 in which said blade is of generally constant thickness along its length, and said slot is of generally constant width except at the leading end of said shank where said slot walls taper forwardly inwardly to a slot width slightly less than the constant thickness of said blade.

4. A screwdriver according to claim 1 in which the length of said nut is equal to at least one half the length of said blade, at least one half of the blade being engaged with said nut when the blade is in its maximum advanced position beyond said slot open end.

5. A screwdriver for alternative use with Phillips head screws and slotted head screws, said screwdriver including a shank the leading end of which terminates in a Phillips head screw engaging bit, said leading end being bifurcated by a rearwardly extending slot, an elongated blade slidingly disposed within said slot, the leading end of said blade terminating in a slotted head screw engaging bit, said blade having a series of gear teeth spaced therealong, and a nut encircling said shank, said nut being freely rotatable about said shank but being in fixed axial position therealong, said nut being meshed with said blade teeth for causing axial movement of said blade along and outwardly beyond the open end of said slot upon rotation of said nut.

6. A screwdriver for alternative use with Phillips head screws and slotted head screws, said screwdriver including a shank the leading end of which terminates in a Phillips head screw engaging bit, said leading end being bifurcated by a rearwardly extending slot, an elongated blade slidingly disposed within said slot, the leading end of said blade terminating in a slotted head screw engaging bit, and means engaging said blade for providing continuous adjustment of the blade over a length of travel of the blade both forwardly and rearwardly of said Phillips head bit, and said means engaging said blade for securely and firmly positioning said blade at any point to which it is adjusted and including a nut encircling said shank which is mechanically coupled to said blade for continuously controlling and securing the adjustment of said blade along its length of travel, wherein said means engaging said blade includes a nut encircling said shank and having gear means in engagement with said blade for continuously controlling and securing the adjustment of said blade along its length of travel.

* * * * *